US008348087B2

(12) United States Patent
Sawaki

(10) Patent No.: US 8,348,087 B2
(45) Date of Patent: Jan. 8, 2013

(54) COLD BOX AND DELIVERY METHOD USING THE SAME

(75) Inventor: Toshiya Sawaki, Tokyo (JP)

(73) Assignee: Inoac Corporation, Aichi (JP)

( * ) Notice: Subject to any disclaimer, the term of this patent is extended or adjusted under 35 U.S.C. 154(b) by 330 days.

(21) Appl. No.: 12/726,936

(22) Filed: Mar. 18, 2010

(65) Prior Publication Data

US 2011/0226783 A1 Sep. 22, 2011

(51) Int. Cl.
*B65D 25/14* (2006.01)
*B65D 6/00* (2006.01)

(52) U.S. Cl. ..... 220/592.2; 220/4.28; 220/4.29; 220/6; 220/23.86; 220/592.01; 220/592.03; 220/592.09; 220/592.24; 220/666

(58) Field of Classification Search ..... 220/4.28, 220/4.29, 6, 23.86, 23.97, 495.03, 592.01, 220/592.03, 592.09, 592.2, 592.24, 666, 220/752, 768, 769, 23.91; 383/110
See application file for complete search history.

(56) References Cited

U.S. PATENT DOCUMENTS 6,582,124 B2 * 6/2003 Mogil ..... 383/110
2009/0220178 A1 * 9/2009 Azamy ..... 383/110

FOREIGN PATENT DOCUMENTS

GB 2445637 A * 7/2008
JP 10-287372 A 10/1998
JP 2000-203570 A 7/2000
JP 2004-189242 A 7/2004

* cited by examiner

*Primary Examiner* — Anthony Stashick
*Assistant Examiner* — Madison L Poos
(74) *Attorney, Agent, or Firm* — Sughrue Mion, PLLC

(57) ABSTRACT

A cold box is provided. The cold box includes an outer bag which is rectangular and has an upper opening, a lid which closes the upper opening of the outer bag, and a thermal insulator which is foldable and is detachably housed inside the outer bag. The thermal insulator is formed from a pouch-covered thermal insulation material. The thermal insulator includes a bottom wall, a top wall, a front wall, a rear wall, and a pair of side walls. Each of the side walls has a fixed part disposed adjacent to the rear wall and a turning part disposed adjacent to the front wall. The fixed parts are fixed to side faces of the rear wall, respectively, and the turning parts are rotatably coupled to front faces of the fixed parts, respectively. When the thermal insulator is folded, the front faces of the turning parts face each other.

17 Claims, 6 Drawing Sheets

COLD BOX AND DELIVERY METHOD USING THE SAME

BACKGROUND

1. Field of the Invention

The present invention relates to a foldable cold box which can maintain low temperature for a certain period, and a delivery method using the cold box.

2. Description of Related Art

A thermally insulating cold box is used for storing and transporting goods such as frozen foods or refrigerated foods that are required to maintain its frozen or refrigerated state.

As a related art cold box, an integrally molded foamed polystyrene box is generally known. Because this foamed polystyrene box is integrally molded, it provides excellent sealing property and thermal insulation. However, since the integrally molded foamed polystyrene box cannot be folded, it becomes bulky when it is empty.

As another related art cold box, JP-A-2004-189242 describes a foldable cold box. This cold box has a structure in which a plurality of thermal insulation boards are combined such that, when there are no goods to be placed therein, the cold box is folded in a compact form so as to facilitate its handling. However, because a gap is created between the adjacent thermal insulation boards in order to obtain the foldable structure, a high thermal insulation cannot be expected.

Further, in many cases, cold boxes are roughly handled. Therefore, high strength is required for repetitive use. However, the foamed polystyrene boards may not have sufficient strength. As for the cold box described in JP-A-2004-189242, the strength is sacrificed due to the foldable structure.

Further, when delivering goods using the cold box described in JP-A-2004-189242, a vehicle having a refrigerating function is essential in order to compensate for deteriorated thermal insulation performance resulting from its foldable structure. Moreover, in a delivery center, goods are generally placed inside the cold box on top of one another. However, a flap lid of the cold box described in JP-A-2004-189242 is provided on a lateral side of the cold box, which may not fit for efficient packing work.

SUMMARY OF THE INVENTION

Illustrative aspects of the present invention provide a cold box which is foldable in a compact form and has high thermal insulation performance and strength, and an efficient delivery method using the cold box.

According to an illustrative aspect of the present invention, a cold box is provided. The cold box includes an outer bag which is rectangular and has an upper opening, a lid which closes the upper opening of the outer bag, and a thermal insulator which is foldable and is detachably housed inside the outer bag. The thermal insulator is formed from a pouch-covered thermal insulation material. The thermal insulator includes a rectangular bottom wall, a top wall attached to the lid, a front wall vertically extending from one long side of the rectangular bottom wall, a rear wall vertically extending from the other long side of the rectangular bottom wall, an inner face of the rear wall being opposed to an inner face of the front wall, and a pair of side walls vertically extending from a pair of short sides of the rectangular bottom wall, respectively. Each of the side walls has a fixed part disposed adjacent to the rear wall and a turning part disposed adjacent to the front wall. The fixed parts are fixed to side faces of the rear wall, respectively, and the turning parts are rotatably coupled to front faces of the fixed parts, respectively. When the thermal insulator is folded, the front faces of the turning parts face each other.

According to another illustrative aspect of the present invention, the bottom wall is rotatably coupled to the rear wall. When the thermal insulator is folded, the bottom wall is disposed in a space defined by the rear wall, the fixed parts and the turning parts.

According to yet another illustrative aspect of the present invention, each of the side walls includes a pouch inside which the fixed part and the turning part are disposed. A portion of the pouch between the fixed part and the turning part is seamed to serve as a hinge.

According to yet another illustrative aspect of the present invention, each of the side walls includes a strap via which the fixed part is coupled to the turning part.

According to yet another illustrative aspect of the present invention, the bottom wall is rotatably coupled to the rear wall. Each of the side walls includes a pouch inside which the fixed part and the turning part are disposed. A portion of the pouch between the fixed part and the turning part is seamed to serve as a hinge.

According to yet another illustrative aspect of the present invention, the cold box further includes a strap via which the bottom wall is coupled to the rear wall.

According to yet another illustrative aspect of the present invention, each of the side wall further includes a reinforcing pad provided in a front end portion of the turning part.

According to yet another illustrative aspect of the present invention, the top wall fits into an opening defined by the front wall, the rear wall and the side walls, and the lid covers respective upper faces of the front wall, the rear wall and the side walls.

According to yet another illustrative aspect of the present invention, the cold box further includes a handle attached to the inner face of the rear wall.

According to a yet another illustrative of the present invention, a method for delivering goods is provided. The method includes assembling foldable cold boxes in a delivery center having a refrigerating facility, placing, in the delivery center, the goods inside the cold boxes for respective stores, stacking the cold boxes in a vehicle, delivering the goods to the respective stores together with the cold boxes, receiving empty cold boxes from the respective stores, and bringing back the empty cold boxes in a folded manner. Each of the cold boxes includes an outer bag which is rectangular and has an upper opening, a lid which closes the upper opening of the outer bag, and a thermal insulator which is foldable and is detachably housed inside the outer bag. The thermal insulator is formed from a pouch-covered thermal insulation material. The thermal insulator includes a rectangular bottom wall, a top wall attached to the lid, a front wall vertically extending from one long side of the rectangular bottom wall, a rear wall vertically extending from the other long side of the rectangular bottom wall, an inner face of the rear wall being opposed to an inner face of the front wall, and a pair of side walls vertically extending from a pair of short sides of the rectangular bottom wall, respectively. Each of the side walls has a fixed part disposed adjacent to the rear wall and a turning part disposed adjacent to the front wall. The fixed parts are fixed to side faces of the rear wall, respectively, and the turning parts are rotatably coupled to front faces of the fixed parts, respectively. When the thermal insulator is folded, the front faces of the turning parts face each other.

According to one or more illustrative aspects of the present invention, an internal space of the cold box is surrounded by the thermal insulator and the outer bag covering the thermal insulator. Therefore, the cold box having a high thermal insulation performance can be provided.

Further, the pair of side walls are fixed to the side faces of the rear wall, respectively, such that the side walls and the rear wall form a U-shaped structure. Therefore, the cold box has high resistance against a torsion load. Moreover, since the fixed parts of the side walls are secured to the side faces of the rear wall, an external force applied to the fixed parts presses the fixed parts against the rear wall. Thus, the side walls are resistant to coming off the rear wall. In addition, the fixed parts of the side walls and the rear wall are covered with the outer bag such that, when the external force is applied to the fixed parts, the fixed parts are held between the rear wall and the outer bag. Thus, the fixed parts are reliably prevented from coming off the rear wall. Accordingly, the cold box having a high strength can be provided.

Furthermore, when the thermal insulator is folded, the front faces of the turning parts face each other such that the turning parts do not interfere with each other. Thus, the cold box can be folded in a compact form.

Further, the lid of the cold box is provided as an upper face of the cold box. Therefore, when opening or closing the cold box, leakage of cold air inside the cold box to the outside of the cold box is suppressed. Because the cold box has an excellent thermal insulation performance, the goods can be transported from the delivery center to the respective stores without using a vehicle having a refrigerating function. Further, since the lid is provided on the top of the cold box, in the delivery center, the goods can be placed inside the cold box from above. Thus, efficiency of packing work can be improved. Furthermore, the cold box has a high strength such that the walls forming the four lateral sides of the box can respectively support a load. Therefore, even a plurality of cold boxes can be stacked without damaging the cold boxes, thereby saving a space for transporting the cold boxes.

DETAILED DESCRIPTION

Hereinafter, an exemplary embodiment of the present invention will be described in detail with reference to the drawings.

Figure 1:
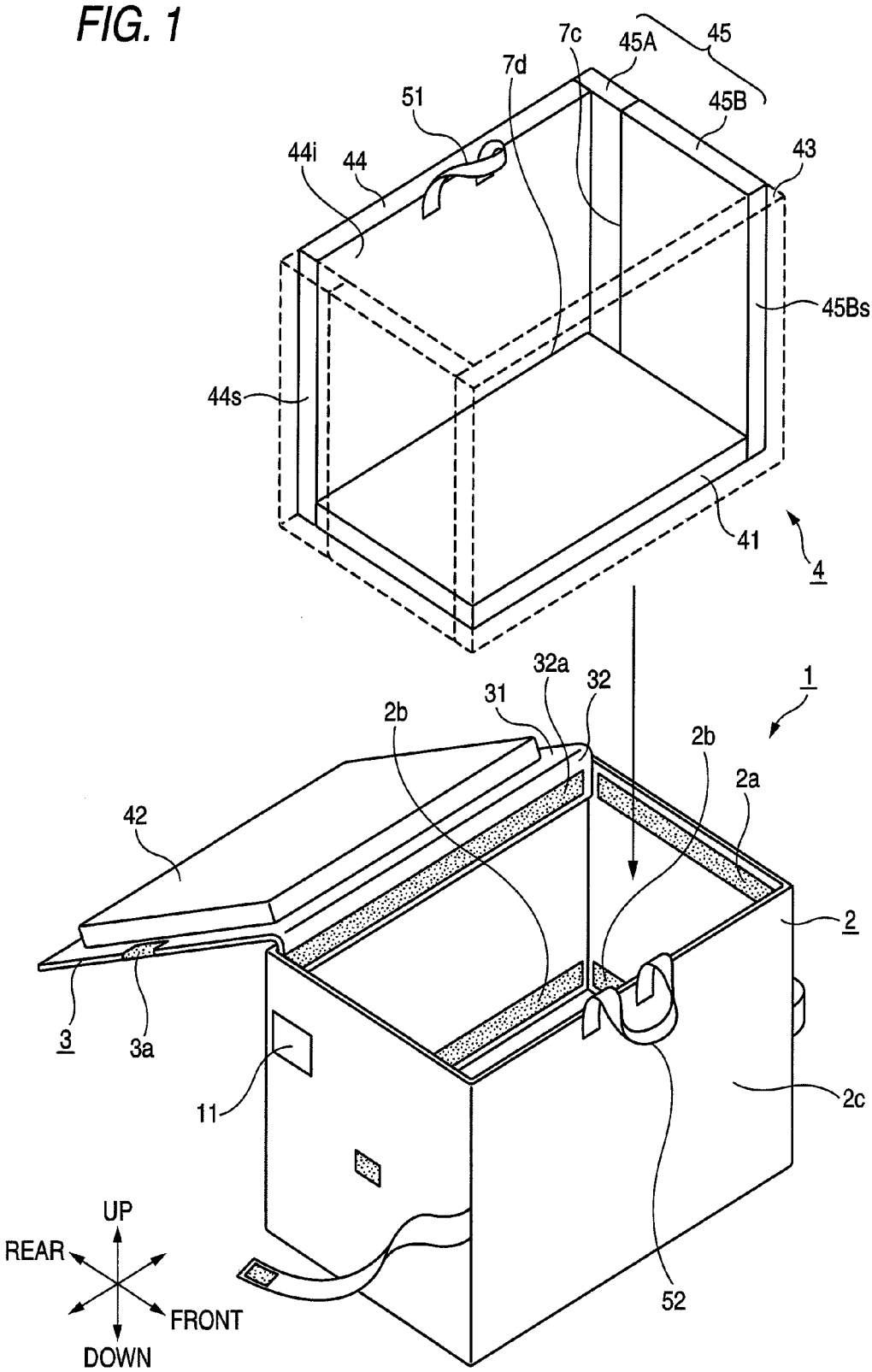
FIG. 1 is an exploded perspective view of a cold box according to an exemplary embodiment of the present invention.

FIG. 1 is an exploded perspective view of a cold box 1 according to an exemplary embodiment of the present invention. The cold box 1 includes an outer bag 2, a lid 3, a rectangular thermal insulator 4 housed inside the outer bag 2, and handles 51, 52 and 53 (see also FIGS. 4 and 5). In FIG. 1, the lid 3 of the cold box 1 is opened.

<Outer Bag>

As shown in FIG. 1, the outer bag 2 is a rectangular bag having an upper opening. The outer bag 2 is made of a flexible material. The outer bag 2 improves thermal insulation property of the cold box 1, and prevents liquid from leaking outside the cold box 1. Further, the outer bag 2 protects the thermal insulator 4 from being damaged. The outer bag 2 is formed from a woven cloth made of polyethylene or polyester, and an aluminum-deposited polyester sheet arranged on an outer side of the woven cloth for shielding a transfer of radiation heat. Further, since the aluminum-deposited polyester sheet serves as an excellent gas barrier, the smell of food inside the cold box 1 can be prevented from leaking outside.

<Lid>

The lid 3 is a thermally insulating member formed from a woven cloth made of polyethylene or polyester and an aluminum deposited polyester film arranged on an outer side of the woven cloth. As shown in FIG. 1, the lid 3 is provided along an upper edge of the outer bag 2 so as to close the upper opening of the outer bag 2. The lid 3 includes a rectangular cover part 31 which covers the upper opening of the outer bag 2, and a flap part 32 extending from one long side of the cover part 31. The lid 3 can be bent at a part between the cover part 31 and the flap part 32.

<Thermal Insulator>

The thermal insulator 4 is a foldable member and forms a frame of the cold box 1. The thermal insulator 4 is placed inside the outer bag 2 as shown in FIG. 1. The thermal insulator 4 includes a bottom wall 41, a top wall 42, a front wall 43, a rear wall 44, and a pair of side walls 45, whereby an internal storage space is formed therein. In FIG. 1, for the purpose of better illustrating the bottom wall 41 and the rear wall 44, the front wall 43 and one of the side walls 45 are shown by a dotted line.

Figure 6:
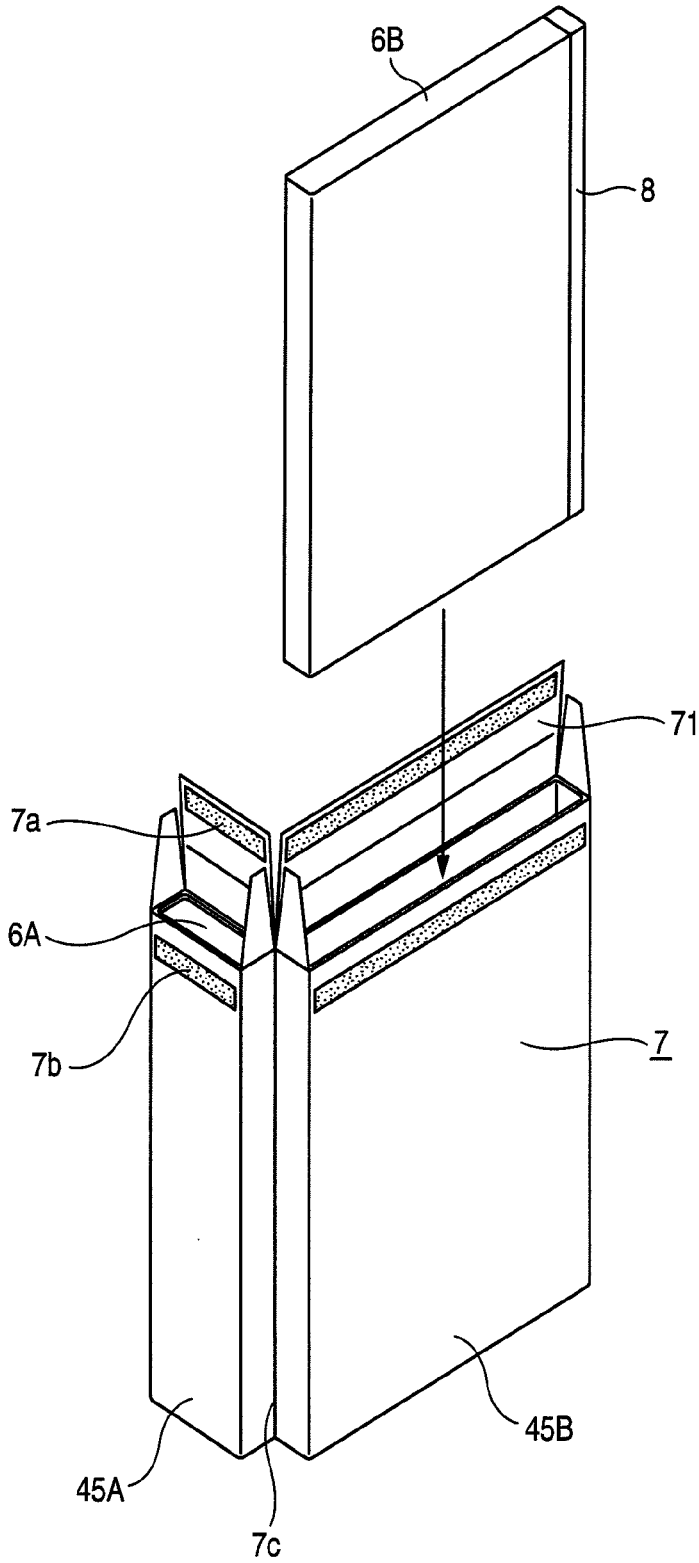
FIG. 6 is an exploded perspective view of a side wall of the cold box.
Figure 7:
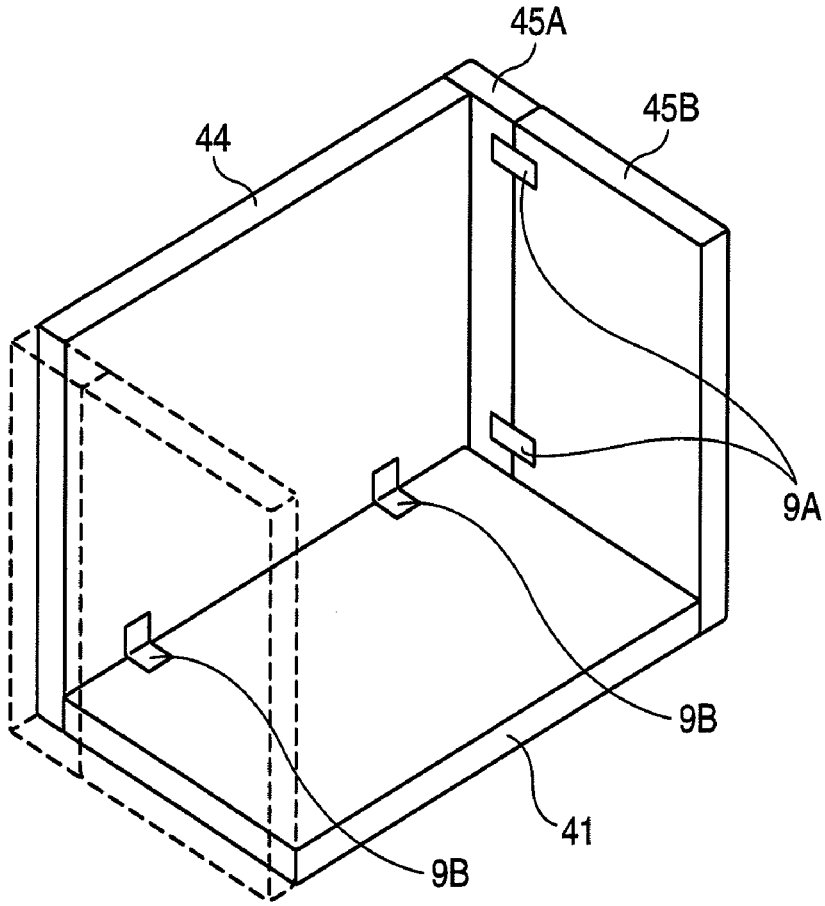
FIG. 7 is a perspective view of a thermal insulator of a cold box according to a modified example of the exemplary embodiment of the present invention.

Each of the walls 41 to 45 of the thermal insulator 4 has a thermal insulation board made of thermal insulation material such as a hard polyurethane foamed material having a sufficient level of strength and thermal insulation property to function as a cold box, and a thermal insulation pouch 7 which covers the thermal insulation board (see FIG. 6). The pouch 7 is formed from a woven cloth made of polyethylene or polyester and an aluminum deposited polyester film arranged on an outer side of the woven cloth. Thermal insulation inside the internal storage space defined by the thermal insulator 4 is ensured by the thermal insulator 4, and is further improved by the outer bag 2 that surrounds the thermal insulator 4.

Each of the walls 41 to 45 of the thermal insulator 4 will be described below in detail. The bottom wall 41 has a rectangular shape, and is arranged on a bottom of the cold box 1. The top wall 42 is attached to the cover part 31 of the lid 3, and is arranged so as to be opposed to the bottom wall 41. The front wall 43 extends vertically from one long side of the bottom wall 41, and has the largest area among the walls 41 to 45. The rear wall 44 extends vertically from the other long side of the bottom wall 41, and is arranged such that an inner face 44*i* (facing the internal storage space) of the rear wall 44 is opposed to an inner face 43*i* (see FIG. 4) of the front wall 43. The rear wall 44 is rotatably coupled to the bottom wall 41. A pair of side walls 45 extend vertically from a pair of short sides of the rectangular bottom wall 41, respectively, and are arranged between the front wall 43 and the rear wall 44. Each of the side walls 45 has a fixed part 45A disposed adjacent to the rear wall 44, and a turning part 45B disposed adjacent to the front wall 43. The turning part 45B is coupled to the fixed part 45A so as to be rotatable toward the internal space of the cold box 1.

On an outer face 43*o* of the front wall 43 and an outer face of the side walls 45, hook-and-loop fasters is arranged (see FIG. 5) so that the front wall 43 and the side walls 45 are detachably attached to the counterpart hook-and-loop fasters 2*a* and 2*b* which are horizontally arranged on upper and lower parts of inner face of the outer bag 2. The rear wall 44 is detachably attached to the outer bag 2 via a hook-and-loop fastener 32*a* arranged on the flap part 32 of the lid 3 and a hook-and-loop fastener 2*b* arranged on a lower part of the inner face of the outer bag 2. The bottom wall 41 and the top wall 42 may likewise be detachably attached to the outer bag 2 by using hook-and-loop fasteners. A hard plastic plate may be disposed on an inner face of the bottom wall 41 to reinforce the bottom wall 41.

When folding the cold box 1 having the configuration described above, as shown in FIG. 2, the turning parts 45B of the thermal insulator 4 are rotated in the horizontal direction such that vertical front faces 45Bs of the turning parts 45B face each other. The bottom wall 41 of the thermal insulator 4 is upwardly rotated around a hinge part 7*d* such that the inner face of the bottom wall 41 is opposed to the inner face 44*i* of the rear wall 44. Accordingly, the bottom wall 41 is vertically placed in a space defined by the rear wall 44, the fixed parts 45A and the rotated turning parts 45B. In this way, the cold box 1 is folded in a compact form, thereby providing a structure that is convenient for transportation.

Figure 2:
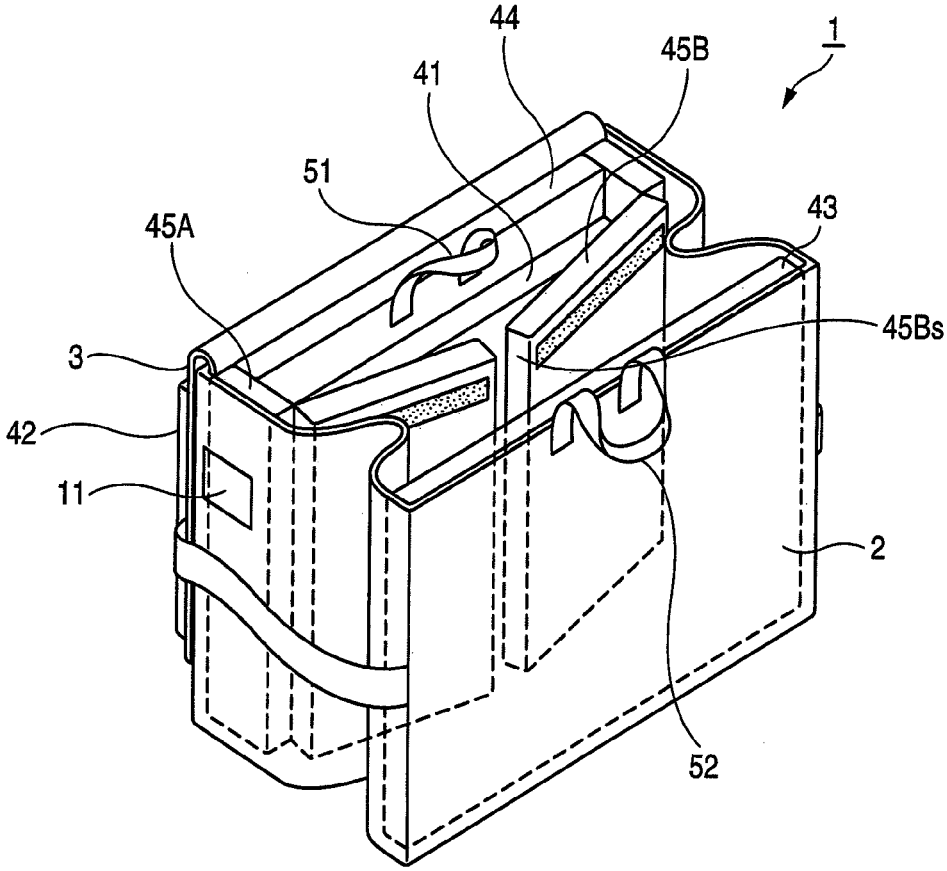
FIG. 2 is a perspective view of the cold box in a folded state.

A pocket 11 may be provided in an outer face of the cold box 1 to insert a slip therein so that the slip can easily be recognized from outside. According to the exemplary embodiment, the pocket 11 is provided is provided on a portion of the outer face 2*c* of the outer bag 2 that corresponds to the fixed part 45A as shown in FIGS. 1 and 2. When the cold box 1 is folded, the fixed part 45A forms one of the lateral sides of the rectangular cold box 1 that has the smallest area. Accordingly, when storing a plurality of the folded cold boxes 1, it is advantageous to place the folded cold boxes side by side such that the outer faces formed by the respective fixed parts 45A face outside, thereby saving a storage space. Moreover, since the pocket 11 is provided on the portion of the outer face 2*c* formed by the fixed part 45A, the slip inside the pocket 11 can easily be recognized when the cold box 1 is folded and stored in the manner described above.

<Folding Method>

Figure 3:
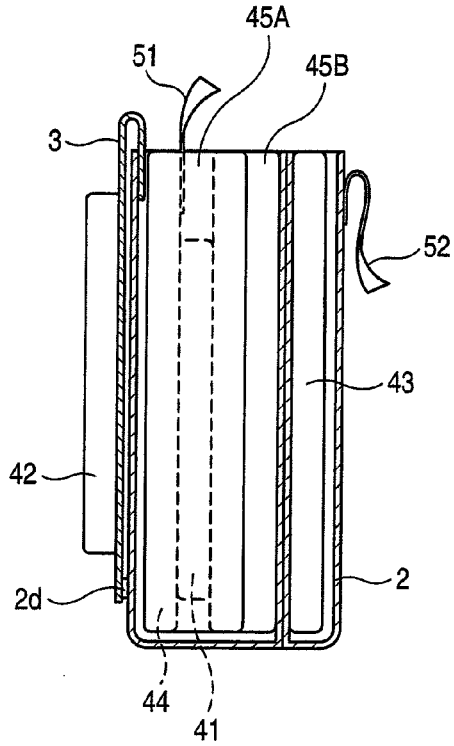
FIG. 3 is a side sectional view of the folded cold box.

FIG. 2 is a perspective view of the cold box 1 in a folded state, and FIG. 3 is a side view of the folded cold box 1. In FIG. 3, in order to better illustrate the thermal insulator 4, a portion of the outer bag 2 is omitted. When folding the cold box 1, firstly, the lid 3 is opened. Then, a front side of the bottom wall 41 is rotated so as to be lifted upward. Subsequently, the pair of turning parts 45B are inwardly rotated such that that the vertical front faces 45Bs of the turning parts 45B face each other. As a result, the bottom wall 41 is placed inside the space defined by the rear wall 44, the pair of fixed parts 45A and the pair of turning parts 45B. Further, the front wall 43 is moved to an open space created by the rotation of the turning parts 45B. Finally, a belt 10 is fastened to the cover part 31 of the lid 3 by means of a hook-and-loop fastener 3*a* provided on the cover part 31 so as to maintain the folded state of the cold box 1. A hook-and-loop fastener 2*d* (see FIG. 3) may be provided on the outer face of the outer bag 2 adjacent to the rear wall 44 to secure the lid 3 so that the lid 3 does not rotate when the cold box 1 is folded.

Figure 4:
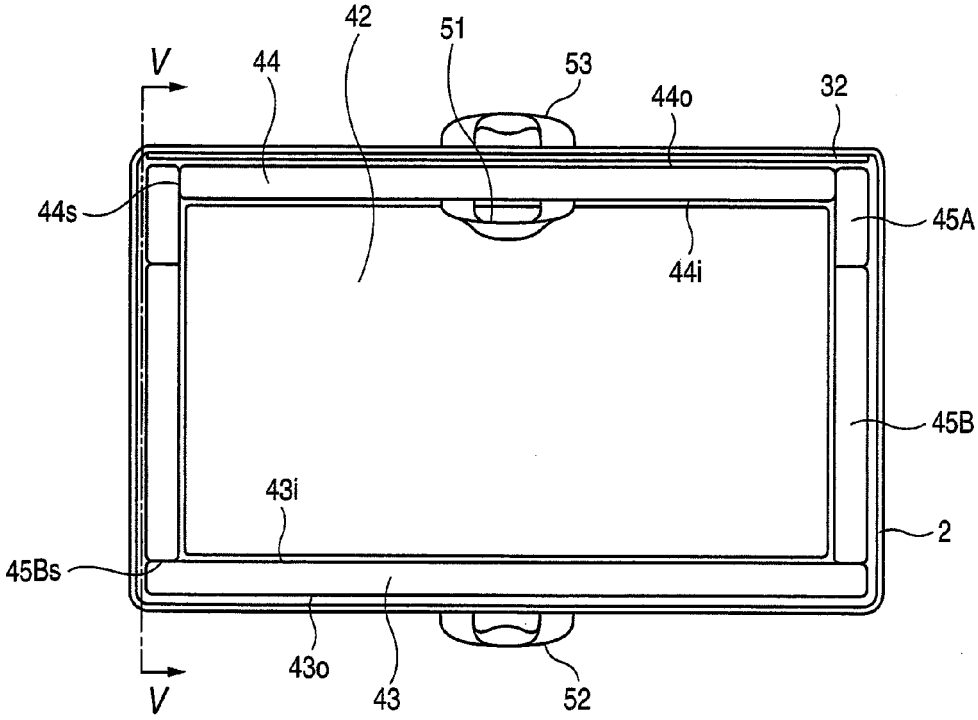
FIG. 4 is a top view of the cold box from which a cover part of a lid is removed.
Figure 5:
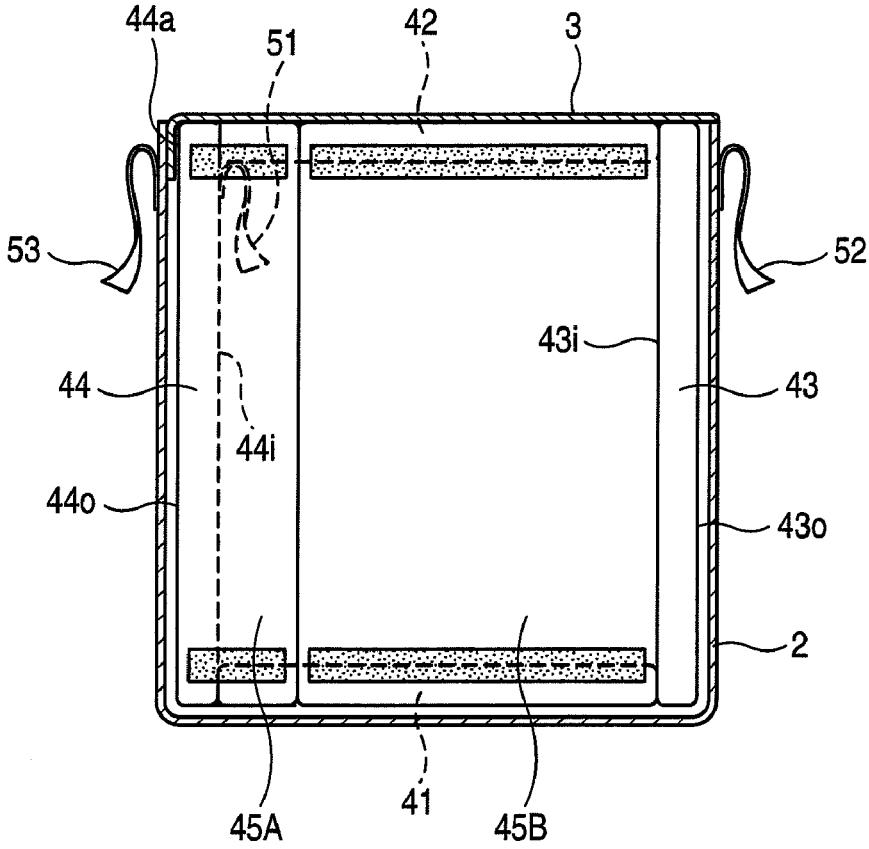
FIG. 5 is a sectional view of the cold box taken along the line V-V of FIG. 4.

Next, with reference to FIGS. 1 and 4 to 7, detailed structures of the cold box 1 will be described. FIG. 4 is a top view of the cold box 1 in an assembled state with the lid 3 being closed. However, In order to better illustrate the top wall 42 of the thermal insulator 4, the cover part 31 of the lid 3 is not shown in FIG. 4. FIG. 5 is a side sectional view taken along the line V-V of FIG. 4.

First, with reference to FIGS. 1, 4 and 5, the lid 3 will be described. The lid 3 seals the cold box 1 to improve thermal insulation property. The flap part 32 of the lid 3 is arranged between the outer bag 2 and the rear wall 44 of the thermal insulator 4. A hook-and-loop fastener is horizontally provided on an upper part 44*a* of an outer face 44*o* of the rear wall 44, and is fastened to the counterpart hook-and-loop fastener 32*a* provided on the inner face of the flap part 32. Further, another hook-and-loop fastener (not shown) is provided on an outer face of the flap part 32, and is fastened to a counterpart hook-and-loop fastener (not shown) provided on the inner face of the outer bag 2. In this way, a hinge part of the lid 3 is firmly held between the outer bag 2 and the rear wall 44.

As shown in FIGS. 1 and 5, the cover part 31 of the lid 3 is wider than the top wall 42 of the thermal insulator 4 such that, when the lid 3 is closed, an outer peripheral area of the inner face of the cover part 31 abuts on respective upper faces of the front wall 43, the rear wall 44 and the pair of side walls 45 of the thermal insulator 4. The thermal insulation of the internal space of the cold box 1 ensured by tight abutment between side faces of the top wall 42 and the inner faces of the front wall 43, the rear wall 44 and the pair of side walls 45. In addition to this structure, the cover part 31 abuts on the upper faces of the front wall 43, the rear wall 44 and the pair of side walls 45 so that the thermal insulation is further improved. Hook-and-loop fasteners may be provided on the upper faces of the walls 43 to 45 and the outer peripheral area of the inner face of the cover part 31 to make tight abutment between the lid 3 and the thermal insulator 4 so as to further improve the thermal insulation of the internal space.

The lid 3 is provided to close the upper opening of the thermal insulator 4 and the entire thermal insulator 4 is covered with the outer bag 2. Thus, cold air, which is heavier than warm air, can be maintained inside the cold box 1. Accordingly, the cold box 1 having an excellent thermal insulation performance can be provided.

<Improvement of Strength by Bottom Wall and Top Wall>

Next, with reference to FIGS. 4 and 5, the bottom wall 41 and the top wall 42 of the thermal insulator 4 will be described. The bottom wall 41 and the top wall 42 of the thermal insulator 4 are fitted in an opening defined by the front wall 43, the rear wall 44 and the pair of side walls 45 from below and above, respectively. That is, the inner faces of the front wall 43, the rear wall 44 and the pair of side walls 45 abut on the bottom wall 41 and the top wall 42, respectively. Therefore, even when an external force is exerted on one or more of the front wall 43, the rear wall 44 and the side walls 45, the bottom wall 41 and the top wall 42 prevent the walls 43 to 45 from being inwardly deformed or displaced. Accordingly, the cold box 1 is highly resistant to a sideward force applied to the cold box 1.

<Improvement of Strength by Rear Wall and Side Wall>

Next, the rear wall 44 and the side walls 45 of the thermal insulator 4 will be described. As shown in FIG. 4, the rear wall 44 and the pair of side walls 45 together form an angled U-shaped structure. Therefore, the cold box 1 is also highly resistant to a torsion force applied to the cold box 1. The fixed parts 45A of the side walls 45 may be fixed to vertical side faces 44*s* of the rear wall 44 by fixing means such as an adhesive agent so as to hold the rear wall 44 between the fixed parts 45A. Thus, even when the external force is applied to the side walls 45, the fixed parts 45A are pressed onto the rear wall 44, whereby the side walls 45 are prevented from coming off the rear wall 44.

When the thermal insulator 4 is folded as shown in FIG. 2, the inner faces of side walls 45 do not abut on the top wall 42. Thus, the prevention of the deformation and displacement of the side walls 45 by the bottom wall 41 and the top wall 42 as described above cannot be expected. However, the fixed parts 45A of the thermal insulator 4 are fixed to the vertical side faces 44*s* of the rear wall 44 and the outer sides of the fixed parts 45A are covered with the outer bag 2. Further, the side faces of the bottom wall 41, which is upwardly rotated, are held between the inner faces of the fixed parts 45A. Therefore, even when the cold box 1 is folded, the cold box 1 is highly resistant to an external force is applied to the side walls 45. More specifically, when the external force is applied to a central portion of one of the side walls 45, the front side of the fixed part 45A biased to rotate inward and the rear side of the fixed part 45A is biased to rotate outward. However, the outer bag 2 covering the outer side of the fixed part 45A prevents the rear side of the fixed parts 45A from rotating outward. Further, the bottom wall 41 between the fixed parts 45A absorbs the external force. Accordingly, the fixed part 45A is prevented from coming off the vertical side face 44*s* of the rear wall 44. Therefore, the cold box 1 is prevented from being collapsed even when the external force is applied to the side walls 45 of the folded state.

<Removable Structure of Thermal Insulation Board>

Now, with reference to FIG. 6, an internal structure of each of the walls 41 to 45 will be described in detail, referring to the side wall 45 as an example. FIG. 6 is an exploded perspective view of the side wall 45. The side wall 45 includes thermal insulation boards 6A and 6B forming the fixed part 45A and the turning part 45B, and a pouch 7 which covers the thermal insulation boards 6A and 6B. The thermal insulation boards 6A and 6B may be made from boards of rigid polyurethane foam.

Two openings are provided in an upper part of the pouch 7. On a distal end of a protruding part 71 of the pouch 7 that upwardly protrudes from the openings, a hook-and-loop fastener 7*a* is provided. The counterpart hook-and-loop fastener 7*b* is provided on a portion below the openings. The thermal insulation boards 6A and 6B are inserted from the openings, respectively, and the protruding part 71 is folded to cover the openings such that the openings are closed by the hook-and-loop fasteners 7*a* and 7*b*. Because the hook-and-loop fasteners 7*a* and 7*b* are used, the thermal insulation boards 6A and 6B can easily be inserted in and taken out. Thus, in the event that the thermal insulation boards 6A and 6B are broken, the thermal insulation boards 6A and 6B can easily be exchanged. While it is not explicitly illustrated in the drawings, the bottom wall 41, the top wall 42, the front wall 43 and the rear wall 44 have similar structures in which thermal insulation boards can easily be inserted in and taken out like the side wall 45.

Further, on a vertical front side (a right side in FIG. 6) of the thermal insulation board 6B forming the turning part 45B, a layer of reinforcing pad 8 is provided. The reinforcing pad 8 is made of a material, e.g., formed styrene, which is softer than the material of the thermal insulation boards 6A and 6B, so that the reinforcing pad 8 is easily compressed and deformed. When folding or assembling the cold box 1, the vertical front faces 45Bs (see FIG. 4) of the turning parts 45B contact the front wall 43, which may damage corner portions of the thermal insulation boards 6B. Accordingly, in order to protect the corner portions of the thermal insulation boards 6B, the reinforcing pads 8 are provided on the vertical front side of the thermal insulation boards 6B. For example, when assembling the cold box 1, the turning parts 45B are moved to their positions while the reinforcing pads 8 are being compressed. Therefore, the corner parts of the thermal insulation boards 6B can be prevented from being damaged. Further, gaps between the front wall 43 and the vertical front faces 45Bs of the turning parts 45B are sealed by the compressible reinforcing pads 8. Thus, the thermal insulation property of the cold box 1 is further improved.

<Hinge Structure>

Next, a hinge structure 7*c* between the fixed part 45A and the turning part 45B (see FIG. 6) and a hinge structure 7*d* between the bottom wall 41 and the rear wall 44 (see FIG. 1) will be described below.

As shown in FIG. 6, along a portion of the pouch 7 between the thermal insulation boards 6A and 6B, a seam 7*c* is formed by sewing an outer layer and an inner layer of the pouch 7 together, so that the turning part 45B is relatively rotatable around the seam 7*c* with respect to the fixed part 45A. Because the seam 7*c* is provided to function as a hinge, the cold box 1 can be provided more inexpensively than a cold box using a mechanical metal hinge or a hard resin hinge. Further, since the mechanical metal hinge and the hard resin hinge are not used, thermal insulation boards 6A and 6B made from boards of rigid polyurethane foam or the food inside the internal space are prevented from being damaged.

Further, as shown in FIG. 1, the bottom wall 41, the rear wall 44 and the side walls 45 of the thermal insulator 4 are formed integrally as a single unit. The bottom wall 41 and the rear wall 44 are covered with a single pouch and are joined together like the fixed part 45A and the turning part 45B described above. That is, the bottom wall 41 and the rear wall 44 are contiguously connected by the pouch. Thus, the thermal insulation property of the cold box 1 is further improved.

To the side faces 44*s* of the rear wall 44, which is joined to the bottom wall 41, the fixed parts 45A, which is joined to the respective turning parts 45B, are secured by the adhesive agent, so that the walls 41, 44 and 45 are joined together, and the strength of the unit is improved. Further, in a boundary between the bottom wall 41 and the rear wall 44, a seam 7*d* (see FIG. 1) is formed in a similar manner as the seam 7*c* described above so that the bottom wall 41 is rotatably coupled to the rear wall 44.

Means for connecting the turning part 45B to the fixed part 45A or connecting the bottom wall 41 to the rear wall 44 is not limited to the seams 7*c* and 7*d* described above. For instance, according to a modified example shown in FIG. 7, a bottom wall 41, a rear wall 44, a fixed wall 45A and a rotating wall 45B may be provided as separate components, and the turning part 45B may be connected to the fixed part 45A via straps 9A and the bottom wall 41 may be connected to the rear wall 44 via straps 9B.

<Handle>

In order to facilitate the handling of the cold box 1, the cold box 1 includes strap shaped handles 51, 52 and 53. As shown in FIGS. 1, 4 and 5, the handle 51 is attached to the inner face 44*i* of the rear wall 44, the handle 52 is attached to the outer face of the outer bag 2 adjacent to the front wall 43, and the handle 53 is attached to the outer face of the outer bag 2 adjacent to the rear wall 44. On the pouch or the outer bag 2 to which the handles 51, 52 and 53 are attached, patches may be provided on back sides thereof to improve an attaching strength.

When the cold box 1 is folded, the outer face of the outer bag 2 adjacent to the outer face 44*o* (see FIG. 4) of the rear wall 44 is covered with the cover part 31 of the lid 3. However, because the handle 51 is attached to the inner face 44*i* of the rear wall 44, the cold box 1 is easy to handle by gripping the handle 51 even when the cold box 1 is folded. Further, the handle 51 is located near the center of gravity of the cold box 1 in a folded state. Therefore, the folded cold box 1 can be carried in a stable manner. When the cold box 1 is assembled, the handles 52 and 53 may be gripped to carry the cold box 1. Further, handles may be provided on an inner face of the bottom wall 41 or on inner faces of the turning parts 45B to improve efficiency of a folding operation.

Next, a method for delivering goods using the foldable cold box 1 described above will be described.

In a delivery center having a refrigerating facility, a number of cold boxes 1 are provided in a folded manner. Depending on the number of goods to be transported and the number of stores, a required number of cold boxes 1 are assembled.

In the delivery center, in accordance with an order received from each of the stores, the goods for the respective stores are placed inside the cold boxes 1 prepared for the respective stores. Here, because the lids 3 are provided on upper parts of the cold boxes 1, the goods can be dropped in from above into the cold boxes 1 by using a robot or the like. Further, the slips of the respective stores are inserted in the pockets 11 of the corresponding cold boxes 1, so that it becomes easily recognizable the delivery destination of the respective cold boxes 1. Accordingly, efficiency of packing operation is improved.

The cold boxes 1 in which the goods are stored are then stacked and loaded in a vehicle for transportation, and are delivered to the respective stores. According to the cold box 1 of the exemplary embodiment, a vertical load is supported by the front wall 43, the rear wall 44 and the side walls 45 forming the rectangular frame of the cold box 1. Thus, the cold box 1 is highly resistant to the vertical load. Further, as described above, the cold box 1 of the exemplary embodiment also has a high resistance to the external torsion force and to the external sideward force. Accordingly, even when the plurality of cold boxes 1 is stacked, the cold boxes 1 are hardly collapsed. Thus, a large amount of goods can be transported while maintaining the forms of the good, and a transportation efficiency can be improved.

Further, since the thermal insulation performance of the cold box 1 is high, the cold boxes 1 can be transported by maintaining the goods at low temperature without using a vehicle having the refrigerating equipment. Accordingly, a transportation cost can be reduced.

Subsequently, the cold boxes 1 in which the goods are accommodated are unloaded from the vehicle in each of the stores. Then, a driver of the vehicle receives empty cold boxes 1, which are previously delivered, and loads the empty cold boxes 1 on the vehicle in a folded state.

Owing to the high thermal insulation performance of the cold boxes 1, the cold boxes 1 can be left as they are for a long time. This provides flexibility in a working process for a store staff. That is, since the temperature in the cold box 1 can be maintained at a low temperature for a long time, the store staff does not need to immediately unpack the cold boxes 1 arriving at the store. For instance, when the store staff is busy in servicing the customers, the store staff can carry out a work for moving the goods from the cold boxes to a refrigerating facility of the store after servicing the customers.

Further, since the lid 3 is provided on the upper part of the cold box 1 and the lower part of the cold box 1 is covered with the outer bag 2, cold air which is heavier than warm air remains in the cold box 1. Accordingly, even when moving the goods out from the cold boxes 1 to the refrigerating facility of the store, it is not necessary to open and to close the lid 3 each time the goods are taken out from the cold box 1.

Further, the folded cold box 1 is smaller than the assembled cold box 1. Thus, when the cold boxes 1 are unpacked and folded, a larger open space than the folded cold boxes 1 is ensured. Accordingly, the driver of the vehicle is not confused in a reloading work like a puzzle which may require consideration in choosing a restricted space for arranging the cold boxes 1. Thus, the driver can reload the folded cold boxes 1 simply in the open space of the vehicle.

Further, the pocket 11 is provided on an outside of the fixed part 45A that has the smallest area of the cold box 1 formed among the outer faces of the outer bag 2 when the cold box 1 is folded. Therefore, even when the plurality of cold boxes 1 are folded and stored, the slips inside the respective pockets 11 can easily be recognized as to which store the cold box 1 belongs, so that handling efficiency in a subsequent use can be improved.

While the invention has been described in connection with the exemplary embodiments, it will be obvious to those skilled in the art that various changes and modifications may be made therein without departing from the present invention, and it is aimed, therefore, to cover in the appended claim all such changes and modifications as fall within the true spirit and scope of the present invention.

What is claimed is:

1. A cold box comprising:

an outer bag which is rectangular and has an upper opening;

a lid which closes the upper opening of the outer bag; and a thermal insulator which is foldable and is detachably housed inside the outer bag, wherein the thermal insulator is formed from a pouch-covered thermal insulation material, wherein the thermal insulator comprises:

a rectangular bottom wall;

a top wall attached to the lid;

a front wall vertically extending from one long side of the rectangular bottom wall;

a rear wall vertically extending from the other long side of the rectangular bottom wall, an inner face of the rear wall being opposed to an inner face of the front wall; and a pair of side walls vertically extending from a pair of short sides of the rectangular bottom wall, respectively, wherein each of the side walls comprises a fixed part disposed adjacent to the rear wall, and a turning part disposed adjacent to the front wall, wherein the fixed parts are fixed to side faces of the rear wall, respectively, and the turning parts are rotatably coupled to front faces of the fixed parts, respectively, and wherein, when the thermal insulator is folded, the front faces of the turning parts face each other;

the front faces of the turning parts face the front wall when the thermal insulator is unfolded.

2. The cold box according to claim 1, wherein the bottom wall is rotatably coupled to the rear wall, and wherein, when the thermal insulator is folded, the bottom wall is disposed in a space defined by the rear wall, the fixed parts and the turning parts.

3. The cold box according to claim 1, wherein each of the side walls further comprises a pouch inside which the fixed part and the turning part are disposed, and wherein a portion of the pouch between the fixed part and the turning part is seamed to serve as a hinge.

4. The cold box according to claim 1, wherein each of the side walls further comprises a strap via which the fixed part is coupled to the turning part.

5. The cold box according to claim 1, wherein the bottom wall is rotatably coupled to the rear wall, wherein each of the side walls further comprises a pouch inside which the fixed part and the turning part are disposed, and wherein a portion of the pouch between the fixed part and the turning part is seamed to serve as a hinge.

6. The cold box according to claim 1, further comprising a strap via which the bottom wall is coupled to the rear wall.

7. The cold box according to claim 1, wherein the top wall fits into an opening defined by the front wall, the rear wall and the side walls, and wherein the lid covers respective upper faces of the front wall, the rear wall and the side walls.

8. The cold box according to claim 1, further comprising a handle attached to the inner face of the rear wall.

9. The cold box according to claim 1, wherein the turning parts are detached from the front wall.

10. The cold box according to claim 1, wherein each of the side wall further comprises a reinforcing pad provided in a front end portion of the turning part.

11. The cold box according to claim 1, wherein the fixed parts of the side walls have a fixed positional relationship with the rear wall irrespective of a folding condition of the thermal insulator.

12. The cold box according to claim 1, wherein the top wall fits into an opening defined by the front wall, the rear wall and the pair of side walls.

13. A cold box comprising:

an outer bag which is rectangular and has an upper opening;

a lid which closes the upper opening of the outer bag; and a thermal insulator which is foldable and is detachably housed inside the outer bag, wherein the thermal insulator is formed from a pouch-covered thermal insulation material, wherein the thermal insulator comprises:

a rectangular bottom wall;

a top wall attached to the lid;

a front wall vertically extending from one long side of the rectangular bottom wall;

a rear wall vertically extending from the other long side of the rectangular bottom wall, an inner face of the rear wall being opposed to an inner face of the front wall; and a pair of side walls vertically extending from a pair of short sides of the rectangular bottom wall, respectively, wherein each of the side walls comprises a fixed part disposed adjacent to the rear wall, and a turning part disposed adjacent to the front wall, wherein the fixed parts are fixed to side faces of the rear wall, respectively, and the turning parts are rotatably coupled to front faces of the fixed parts, respectively, and wherein, when the thermal insulator is folded, the front faces of the turning parts face each other, wherein each of the side wall further comprises a reinforcing pad provided in a front end portion of the turning part.

14. A method for delivering goods, the method comprising:

assembling foldable cold boxes in a delivery center having a refrigerating facility;

placing, in the delivery center, the goods inside the cold boxes for respective stores;

stacking the cold boxes in a vehicle;

delivering the goods to the respective stores together with the cold boxes;

receiving empty cold boxes from the respective stores; and bringing back the empty cold boxes in a folded manner, wherein each of the cold boxes comprises:

an outer bag which is rectangular and has an upper opening;

a lid which closes the upper opening of the outer bag; and a thermal insulator which is foldable and is detachably housed inside the outer bag, wherein the thermal insulator is formed from a pouch-covered thermal insulation material, wherein the thermal insulator comprises:

a rectangular bottom wall;

a top wall attached to the lid;

a front wall vertically extending from one long side of the rectangular bottom wall;

a rear wall vertically extending from the other long side of the rectangular bottom wall, an inner face of the rear wall being opposed to an inner face of the front wall; and a pair of side walls vertically extending from a pair of short sides of the rectangular bottom wall, respectively, wherein each of the side walls comprises a fixed part disposed adjacent to the rear wall, and a turning part disposed adjacent to the front wall, wherein the fixed parts are fixed to side faces of the rear wall, respectively, and the turning parts are rotatably coupled to front faces of the fixed parts, respectively, and wherein, when the thermal insulator is folded, the front faces of the turning parts face each other; and the front faces of the turning parts face the front wall when the thermal insulator is unfolded.

15. The method for delivering goods according to claim 14, wherein the turning parts are detached from the front wall.

16. The method of delivering goods according to claim 14, wherein the fixed parts of the side walls have a fixed positional relationship with the rear wall irrespective of a folding condition of the thermal insulator.

17. The method of delivering goods according to claim 14, wherein the top wall fits into an opening defined by the front wall, the rear wall and the pair of side walls.

* * * * *